US005607066A

United States Patent [19]

Hebberd

[11] Patent Number: 5,607,066

[45] Date of Patent: Mar. 4, 1997

[54] PANTS RACK ASSEMBLY

[76] Inventor: Charles M. Hebberd, 2918 Sandover Ct., Bonita, Calif. 91902

[21] Appl. No.: 415,307

[22] Filed: Apr. 3, 1995

[51] Int. Cl.[6] ..... A47F 5/08

[52] U.S. Cl. ..... 211/45; 211/87; 211/89; 223/95; 223/96

[58] Field of Search ..... 211/45, 87, 89; 223/95, 96

[56] References Cited

U.S. PATENT DOCUMENTS

| | | | |
|---|---|---|---|
| 2,149,908 | 3/1939 | Poole | 223/96 X |
| 2,913,123 | 11/1959 | Lundberg | 211/89 X |
| 3,426,911 | 2/1969 | Seiling | 211/89 X |
| 3,508,664 | 4/1970 | Lessard | 211/89 |
| 4,049,163 | 9/1977 | Stolz | 211/89 X |
| 4,286,717 | 9/1981 | Liesinger | 211/89 X |
| 4,327,837 | 5/1982 | Ross | 211/87 |
| 4,557,407 | 12/1985 | Bogaczyk | 223/96 |
| 4,811,852 | 3/1989 | Kelly | 211/89 X |
| 5,417,335 | 5/1995 | White | 211/89 X |

*Primary Examiner*—Wynn E. Wood
*Attorney, Agent, or Firm*—Charles C. Logan, II

[57] ABSTRACT

A pants rack assembly to be mounted on the wall of a room. It has a block shaped body member having a front surface from which extends an elongated right side gripping arm, an elongated left side gripping arm and an elongated middle spring support arm. This structure is integrally formed of plastic material. An elongated floating gripping arm is positioned between the middle spring support arm and each of the respective left and right side gripping arms. A pair of coiled springs pass through longitudinally spaced apertures in the middle spring support arm and their opposite ends are seated in recesses in the respective floating gripping arms. The rear end of the block shaped member is telescopically received in a U-shaped channel member that would be secured to the wall.

6 Claims, 1 Drawing Sheet

PANTS RACK ASSEMBLY

BACKGROUND OF THE INVENTION

The invention relates to a clothing support rack and more specifically to a rack assembly for holding pants or trousers.

Several different types of pants or trouser hangers have been designed over the years. The Tye U.S. Pat. No. 853,527 discloses a trouser hanger having a plurality of fingers secured to a frame adjacent one of their ends. The fingers of this structure can be squeezed together adjacent their distal ends but not adjacent their pivoted ends. The Hall U.S. Pat. No. 2,127,333 is also directed to a trouser hanger having finger gripping members and means for adjusting the tension for squeezing a pair of pants between these finger gripping members. The Poole U.S. Pat. No. 2,149,908 also discloses a pants hanger having a plurality of fingers. All of the above structures only allow the free end of the fingers to compress toward each other. The spacing between the other end of the fingers remains substantially constant.

The Creveling et al U.S. Pat. No. 2,952,367 discloses a pant hanger having a plurality of fingers whose front and rear ends can both be separated from each other or compressed toward each other. His structure is designed to be supported on a clothes pole and not from a side wall. The Hartley U.S. Pat. No. 2,926,791 discloses a pants hanger that is also mounted on a clothes pole. The Bogaczyk U.S. Pat. No. 4,557,407 is also directed to a pants hanger that is designed to be supported from a clothes pole.

The Lessard U.S. Pat. No. 3,508,664 discloses a pants rack that is mounted on a wall. It has a pair of elongated pants support members that are pivoted about a longitudinal axis perpendicular to its wall support and mounting member.

It is an object of the invention to provide a novel pants rack assembly that has finger gripping members that can apply perpendicular pressure against a pair of trousers between them along their entire length.

It is another object of the invention to provide a novel pants rack assembly that can be made from a minimum number of parts.

It is also an object of the invention to provide a novel pants rack assembly that is economical to manufacture and market.

It is a further object of the invention to provide a novel pants rack assembly that allows multiple units to be secured to a U-shaped support member.

It is an additional object of the invention to provide a novel pants rack assembly that can be easily installed on the wall of a room.

SUMMARY OF THE INVENTION

The novel pants rack assembly has been designed so that it may be easily and quickly mounted on the wall of a room. The pants rack assembly has a module unit having a block shaped body member with a left side and a right side gripping arm extending forwardly from the front surface of the block shaped body member. An elongated spring support arm extends forwardly from the front surface of the block shaped member intermediate the left and right side gripping arms. The left side gripping arm, the right side gripping arm and the middle spring support arm are integrally formed with the block shaped member and they would be preferably molded from plastic material.

The middle spring support arm has a pair of longitudinally spaced transversely extending apertures in it. A right side floating gripping arm is positioned between the middle spring support arm and the right side gripping arm. A pair of longitudinally spaced recesses are formed in the left side of the right side floating gripping arm and they are respectively aligned with the longitudinally spaced apertures in the middle spring support arm. An elongated left side floating gripping arm is positioned between the middle spring support arm and the left side gripping arm. The left side floating gripping arm has a pair of longitudinally spaced recesses formed in its right side and they are respectively aligned with the longitudinally spaced apertures in the middle spring support arm. Two coiled springs extend through the respective apertures in the middle spring support arm and have their respective ends seated in the respective recesses in the left side floating gripping arm and the right side floating gripping arm. This structure allows the floating gripping arms to travel perpendicular to their respective side gripping arms and provide a constant gripping pressure against the entire width of a pair of pants that are hung between them.

The front end of each of the respective pairs of side gripping arms and floating gripping arms have an inclined or beveled guide surface to aid in sliding a pair of trousers into the pants rack assembly. The respective mating pairs of side gripping arms and floating gripping arms also have a double seam recessed zone formed between them to provide a greater width for the double seam area of a pair of pants.

The U-shaped channel member is preferably made of metal or plastic and may be of any desired length. This allows multiple module units of the block shaped body member to be captured within its open end receptacle area which would be oriented horizontally outwardly from the wall. The U-shaped channel member would be secured by screws passing through longitudinally spaced apertures in its rear connecting wall.

The pants rack assembly has been designed to be assembled from three major structural members and two coiled springs. The major component is the block shaped body member having the integrally formed left and right side gripping arms and the middle spring support arm. Additionally there are two floating gripping arms.

DESCRIPTION OF THE PREFERRED EMBODIMENT

Figure 1:
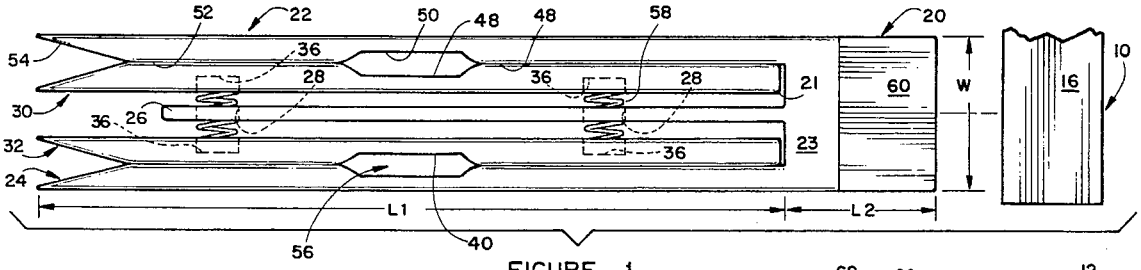
FIG. 1 is an exploded top plan view of the novel pants rack assembly.
Figure 2:
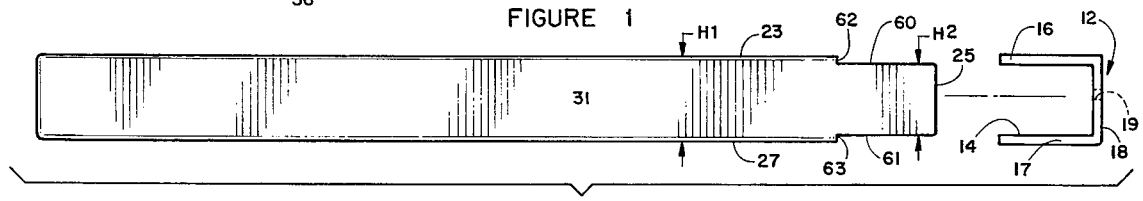
FIG. 2 is an exploded right side elevation view of the novel pants rack assembly.

The novel pants rack assembly will now be described by referring to FIGS. 1–4 of the drawing. The pants rack assembly is generally designated numeral 10.

U-shaped channel member 12 can be any desired length, depending upon the number of module units to be installed in its receptacle opening 14. U-shaped channel member 12 has a top flange 16, a bottom flange 17, and a rear connecting wall 18 with longitudinally spaced screw or nail apertures 19.

A block shaped body member 20 has integrally formed thereto a right side gripping arm 24, a left side gripping arm 22, and a middle spring support arm 26. A pair of longitudinally spaced transversely extending apertures 28 are formed in middle spring support arm 26. Block shaped body member 20 has a front surface 21, 1 top surface 23, a rear surface 25, a bottom surface 27, a left side surface 29 and a right side surface 31.

Figure 3:
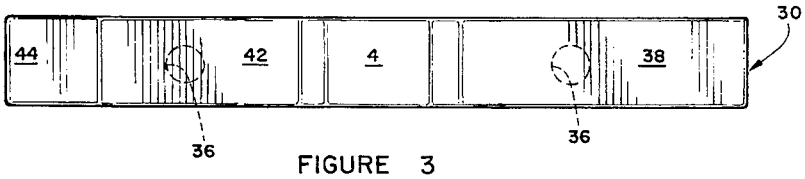
FIG. 3 is a side elevation view of one of the floating gripping arms.
Figure 4:
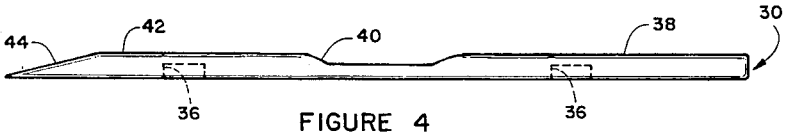
FIG. 4 is a top plan view of one of the floating gripping arms.

A right side floating gripping arm 30 and a left side gripping arm 30 are positioned between middle spring support arm 26 and the respective left and right side gripping arms 24 and 22. Right side floating gripping arm 32 is best illustrated in FIGS. 3 and 4. The rear surface of floating gripping arm 32 has a pair of longitudinally spaced recesses 36 that when properly installed align with apertures 28 in middle spring support arm 26. The front surface of floating gripping arm 32 has a rear planar portion 38, a recessed portion 40, a front planar portion 42 and a sloped or beveled guide surface 44. Floating grip arm 30 is substantially identical to floating grip arm 32. The inner surfaces of left side gripping arm 22 and right side gripping arm 24 are substantially identical. They have a rear planar portion 48, a recessed portion 50, a front planar portion 52, and a sloped or beveled guide surface 54. The opposing recessed portions 40 and 50 form a double seam recess zone 56 for receiving the double seam width of a pair of pants to be hung on the pants rack assembly. Coiled springs 58 have their opposite ends seated in the respective recesses 36.

Block shaped body member 20 has a width W1 in the range of 1.5–4.0 inches. The length of the respective right and left side gripping arms and the right and left floating gripping arms is L1 and L1 is in the range of 6–12 inches. L2 is the length of the block shaped body member and it is in the range of 1–3 inches. The height of block shaped body member 20 is H1 and it is in the range of 0.5–2.0 inches. The top and bottom surfaces of block shaped body member 20 have relieved portions 60 and 61 that form shoulders 62 and 63 respectively. This produces a height H2 which is substantially equal to the height of the receptacle opening 14 of U-shaped channel member 12.

What is claimed is:

1. A pants rack assembly comprising:

a block shaped body member having a top surface, a bottom surface, a rear surface, a front surface, a left side surface and a right side surface, a predetermined height H1, and a predetermined width W1;

an elongated right side gripping arm extending forwardly from the front surface of said block shaped body member adjacent said right side surface;

an elongated left side gripping arm extending forwardly from the front surface of said block shaped body member adjacent said left side surface;

an elongated middle spring support arm extending forwardly from the front surface of said block shaped member; said middle spring support arm being positioned intermediate said left and right side gripping arms; said middle spring support arm having a pair of longitudinally spaced transversely extending apertures;

said left side gripping arm, said right side gripping arm, and said middle spring support arm being connected to with-said block shaped body member;

an elongated right side floating gripping arm positioned between said middle spring support arm and said right side gripping arm; said right side floating gripping arm having a right side and a left side and a pair of longitudinally spaced recesses are formed in said left side and they are respectively aligned with the longitudinally spaced apertures in said middle spring support arm;

an elongated left side floating gripping arm positioned between said middle spring support arm and said left side gripping arm; said left side floating gripping arm having a right side and a left side and a pair of longitudinally spaced recesses are formed in said right side and they are respectively aligned with the longitudinally spaced apertures in said middle spring support arm; and two coiled springs and they each have a first end and a second end and they extend through the respective apertures in said middle spring support arm and have their respective first and second ends seated in the respective recesses in said left side floating gripping arm and said right side floating gripping arm.

2. A pants rack assembly as recited in claim 1 further comprising an elongated U-shaped channel member that forms a receptacle for removably receiving the rear surface of said block shaped body member.

3. A pants rack assembly as recited in claim 2 wherein the top and bottom surface of said block shaped body member is relieved adjacent its rear surface to accommodate the height of the receptacle of said U-shaped channel member.

4. A pants rack assembly as recited in claim 1 wherein said block shaped body member is made of plastic material.

5. A pants rack assembly as recited in claim 1 wherein said left side and right side gripping arms and said left side and right side floating gripping arms have means adjacent their front ends for guiding pants between them for hanging purposes.

6. A pants rack assembly as recited in claim 1 wherein H1 is in the range of 0.5–2.0 inches, W1 is in the range of 1.5–4.0 inches, and said left and right side gripping arms have a length L1 and L1 is in the range of 7–15 inches.

* * * * *